US007775686B2

(12) United States Patent
Dalton et al.

(10) Patent No.: US 7,775,686 B2
(45) **Date of Patent: *Aug. 17, 2010**

(54) CONVERTIBLE FLASHLIGHT AND AREA LIGHT WITH AN APERTURE SHUTTER

(75) Inventors: David R. Dalton, Turramurra (AU); John R. Brown, Mosman (AU); Angelo Kotsis, Marrickville (AU)

(73) Assignee: Eveready Battery Company, Inc., St. Louis, MO (US)

( * ) Notice: Subject to any disclaimer, the term of this patent is extended or adjusted under 35 U.S.C. 154(b) by 172 days.

This patent is subject to a terminal disclaimer.

(21) Appl. No.: 12/072,808

(22) Filed: Feb. 28, 2008

(65) Prior Publication Data

US 2009/0196027 A1 Aug. 6, 2009

Related U.S. Application Data

(63) Continuation of application No. 10/573,960, filed as application No. PCT/AU04/01465 on Oct. 25, 2004, now Pat. No. 7,360,920.

(30) Foreign Application Priority Data

Oct. 27, 2003 (AU) ..... 2003905912

(51) Int. Cl.
*F21V 17/02* (2006.01)

(52) U.S. Cl. ..... 362/321; 362/127; 362/162; 362/166; 362/167

(58) Field of Classification Search ..... 362/127, 362/162, 166, 167, 321
See application file for complete search history.

(56) References Cited

U.S. PATENT DOCUMENTS 1,346,138 A 7/1920 Smalley
1,376,976 A 5/1921 Smalley
1,524,205 A 1/1925 Papke
1,536,623 A 5/1925 Norvell
2,259,416 A * 10/1941 Gardner ..... 362/84
4,286,311 A 8/1981 Maglica
4,577,263 A 3/1986 Maglica
4,609,976 A 9/1986 Geissler
4,782,432 A 11/1988 Coffman
5,305,033 A 4/1994 Takahashi et al.
5,560,705 A 10/1996 Shiau
5,588,739 A 12/1996 Nakao
5,806,961 A 9/1998 Dalton et al.

(Continued)

FOREIGN PATENT DOCUMENTS

GB 2242732 A 10/1991

(Continued)

*Primary Examiner*—Sandra L O'Shea
*Assistant Examiner*—Danielle Allen
(74) *Attorney, Agent, or Firm*—Gregory J. Adams

(57) ABSTRACT

A lighting device which is adapted to be converted between a flashlight mode and an area light mode includes a housing to receive a power supply, a light source associated with the housing and a tubular lens surrounding the light source, a reflector mounted to said device so as to slide relative to the tubular lens, the reflector including an aperture through which the light source can pass, the aperture having a shutter associated therewith whereby the shutter closes the aperture when the reflector is in a position which allows the device to be used in the area light mode.

18 Claims, 4 Drawing Sheets

U.S. PATENT DOCUMENTS

| | | | | |
|---|---|---|---|---|
| 6,004,003 | A | 12/1999 | Dalton et al. | |
| 6,004,008 | A | 12/1999 | Lai | |
| D445,521 | S | 7/2001 | Israel et al. | |
| 6,280,051 | B1 | 8/2001 | Wallach | |
| 6,598,993 | B1 | 7/2003 | Dalton et al. | |
| 2001/0024367 | A1 * | 9/2001 | Shiau | 362/188 |
| 2002/0018343 | A1 * | 2/2002 | Steger | 362/188 |
| 2002/0191396 | A1 * | 12/2002 | Reiff et al. | 362/246 |
| 2006/0109655 | A1 * | 5/2006 | Martin | 362/294 |

FOREIGN PATENT DOCUMENTS

| | | | |
|---|---|---|---|
| GB | 2305718 | A | 4/1997 |
| WO | 9428347 | A1 | 12/1994 |
| WO | 0133137 | A1 | 5/2001 |
| WO | 03074929 | A1 | 9/2003 |

* cited by examiner

CONVERTIBLE FLASHLIGHT AND AREA LIGHT WITH AN APERTURE SHUTTER

RELATED APPLICATION

This application is a continuation of U.S. application Ser. No. 10/573,960, filed Mar. 29, 2006, now U.S. Pat. No. 7,360,920, and entitled "CONVERTIBLE FLASHLIGHT AND AREA LIGHT WITH AN APERTURE SHUTTER", which is a 371 of PCT/AU04/01465, filed Oct. 25, 2004, entitled "CONVERTIBLE FLASHLIGHT AND AREA LIGHT WITH AN APERTURE SHUTTER", which claims priority to AU 2003905912, filed Oct. 27, 2003, entitled "IMPROVEMENTS TO FLASHLIGHTS CONVERTIBLE TO AREA LIGHTS."

FIELD OF THE INVENTION

The present invention relates to lighting devices which are convertible from a flashlight mode to an area mode.

BACKGROUND OF THE INVENTION

The advent of the use of LEDs in flashlights has created a need to optimise the amount of useable light available from the lighting device. Wasted light decreases the efficiency and effectiveness of the light particularly in low powered lighting situations such as provided by LEDs.

The applicant does not concede that the prior art discussed in the specification forms part of the common general knowledge in the art at the priority date of this application.

SUMMARY OF THE INVENTION

The present invention provides a lighting device which is adapted to be converted between a flashlight mode and an area light mode, said device including a housing to receive a power supply, a light source mounted on said housing and a tubular lens surrounding said light source, a reflector mounted to said device so as to slide relative to said tubular lens, said reflector including an aperture through which said light source can pass, said aperture having a shutter associated therewith whereby said shutter closes said aperture when said reflector is in a position which allows said device to be used in said area light mode.

The shutter can be biased to close the aperture.

The shutter can be a panel hinged to a rim of said aperture.

The shutter can include a reflective surface facing said light source when said aperture is closed.

The reflective surface can be specular, white coloured, or light coloured.

The light source can push said shutter to an open condition as said light source passes through said aperture.

The aperture can be located at the end of a cylindrical extension formed as part of said reflector.

The tubular lens can include at least one friction means to provide friction against the movement of said reflector relative to said tubular lens.

The friction means can include an O ring.

The light source can be an LED.

The reflector can be mounted in a tubular member which is in turn mounted for sliding on and relative to said tubular lens.

The shutter can be a planar member having an aperture which can expand and contract.

The planar member can be an elastic membrane.

The aperture can have a diameter when said device is in an area light mode which is smaller than the diameter of the light source.

The aperture can expand by means of the light source pushing through the aperture.

The planar member can be made of a light coloured or white polymeric material.

BRIEF DESCRIPTION OF THE DRAWINGS

An embodiment or embodiments of the present invention will now be described, by way of example only, with reference to the accompanying drawings, in which.

DETAILED DESCRIPTION OF THE EMBODIMENT OR EMBODIMENTS

Figure 1:
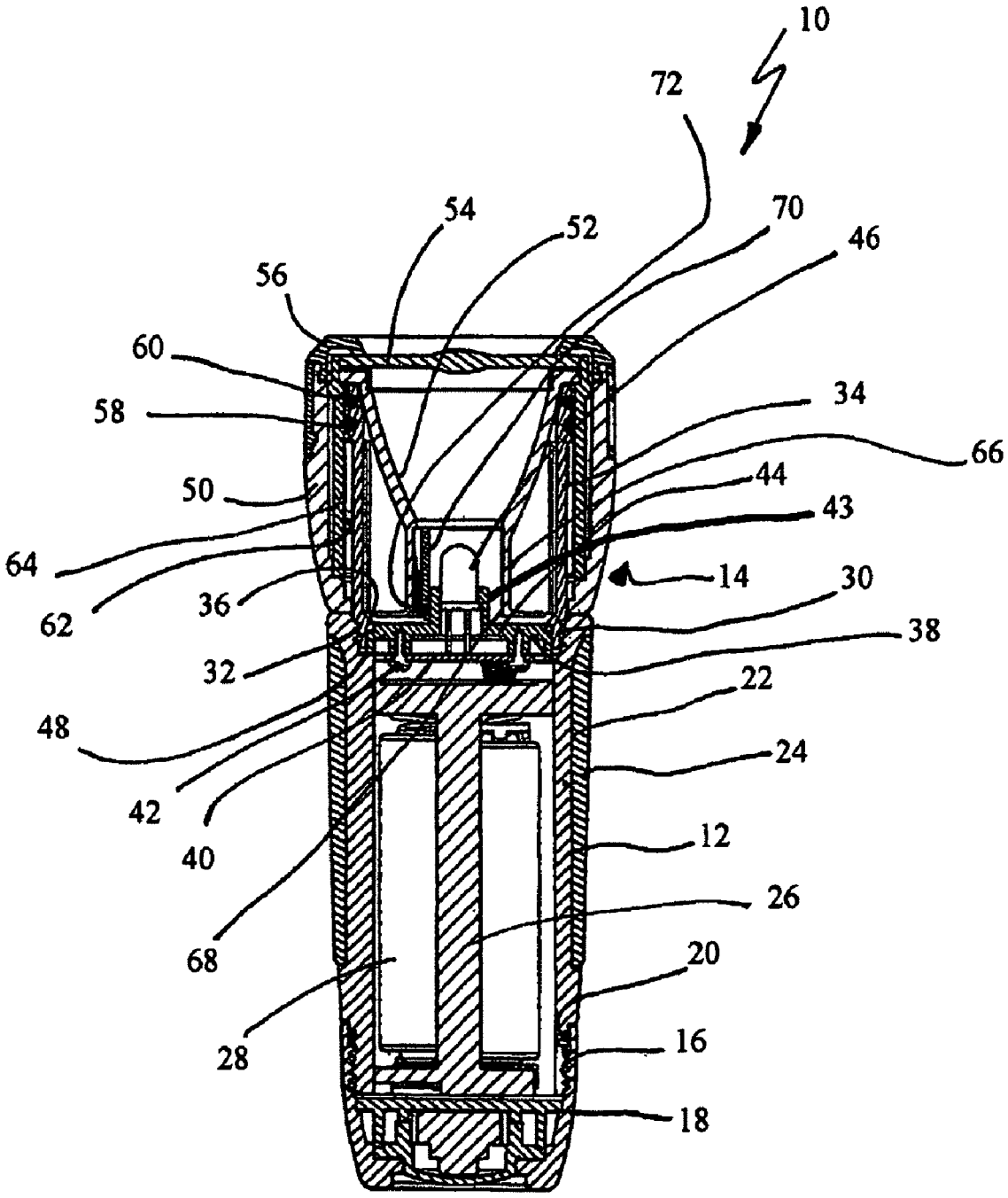
FIG. 1 illustrates a lighting device in cross section.
Figure 2:
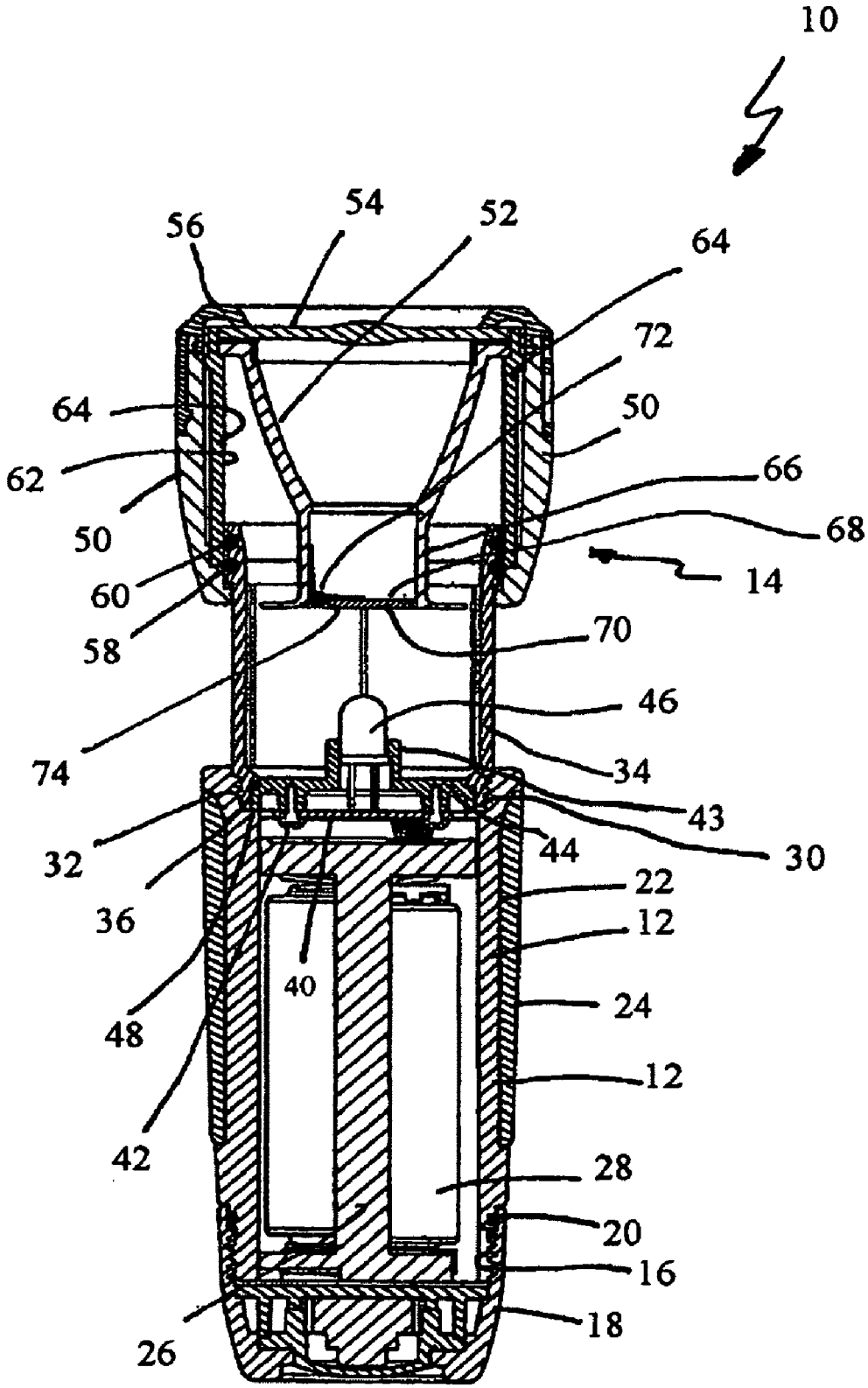
FIG. 2 illustrates the lighting device of FIG. 1 in an area light configuration.

Illustrated in FIGS. 1 and 2 is a lighting device 10 which has a body 12 to house batteries or dry cells 28. The exterior of the body 12 also functions as a handle and carries a light housing 14 which is screwed into the top of the body 12. At the bottom end of the body 12 is a threaded end 16 to receive the combination cap and on/off switch 18. The body also includes an O ring seal 20 to seal with and provide frictional contact with the inside surface of the cap and switch assembly 18 at a rim thereof.

The body 12 includes an annular recess 22 in which sits a rubber sleeve 24 which is decorative and functions as a grip.

The body 12 receives a battery cartridge 26 in which is mounted four AAA dry cells 28.

The light housing 14 is secured to the body 12 by means of male thread 30 which is received into the female thread 32 at the top of the body 12. The male thread 30 is formed at the base of a transparent or translucent tubular lens 34. The lower end of the tubular lens 34 has a flange 36 adjacent thread 30 in which sits a sub assembly 38 comprising a printed circuit board 40 which is screwed by screws 42 to a mounting member 44. The mounting member 44 has a centrally located aperture surrounded by a cylindrical wall 43.

The light source 46 being an LED is mounted by its terminals to the printed circuit board 40 and passes through the aperture in the mounting member 44 and is located by the wall 43, which also serves to hold the LED rigidly in the mounting member 44. The mounting member 44 is located and secured in the body 12 by the flange 36 clamping the rim of the mounting member 44 between flange 36 and an annular shoulder 48 on the body 12 below the female thread 32. Slidably mounted to the outside of the tubular lens 34 is a tubular member 50 which carries a reflector 52 and forward lens 54. The lens 54 and reflector 52 are held in place on the member 50 by a rim 56.

At the top of the tubular lens 34 are two annular grooves in which sit two O rings 58 and 60. The O rings 58 and 60 provide a frictional contact or a source of friction with the inner wall 62 of a cylinder 64 which is also mounted to the member 50.

The reflector 52 has a cylindrical portion 66 extending rearwardly therefrom which will receive the LED 46 therein. The cylindrical portion 66 has an aperture 68 with a shutter 70 at a rim on its free end. The shutter 70 is hinged by a biased hinge 72 which is secured to the cylindrical wall 66. As illustrated in FIG. 1, the shutter 70 is in the open condition having been pushed to that condition by the light source 46 and remaining in that condition by means of the cylindrical wall 43 of mounting member 44.

As seen in FIG. 2, the member 50 has been slid away from the body 12 and the shutter 70 has moved to close the aperture 68 at the end of the cylindrical portion 66. The surface 74 facing the LED 46 preferably has a light coloured, white, reflective or specular surface so that any light emitted from the LED will reflect from this surface 74 and radially outward through the tubular lens 34. If desired, the surface 74 could have a curved profile, either convex or concave, to further assist the reflection of light out through the tubular lens 34. The diameter or shape of the cavity defined by the cylindrical portion 66 will accommodate therein the shutter 70 rotating between its open and closed conditions. In the open condition the lighting device 10 is used in a flashlight mode. However when the shutter is in the closed condition because the member 50 has been moved away from the body 12, the lighting device 10 is in an area lighting mode.

The hinge 72, due to the bias it provides, forces the shutter 70 to the closed condition when the cylindrical wall 43 of mounting member 44 and the LED 46 are not protruding into the aperture 68.

Figure 3:
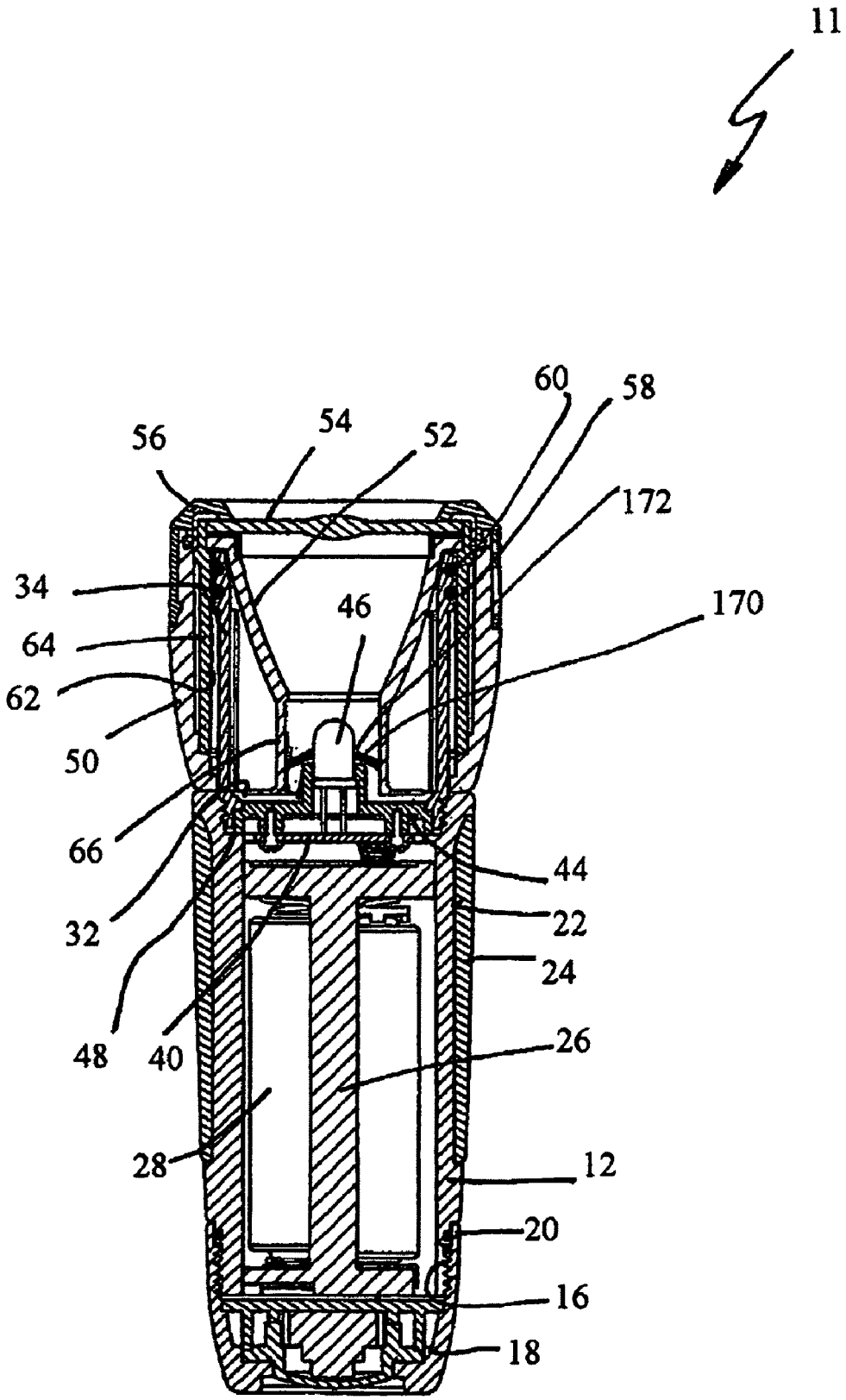
FIG. 3 illustrates an alternative version of the light of FIG. 1 in a flashlight condition.
Figure 4:
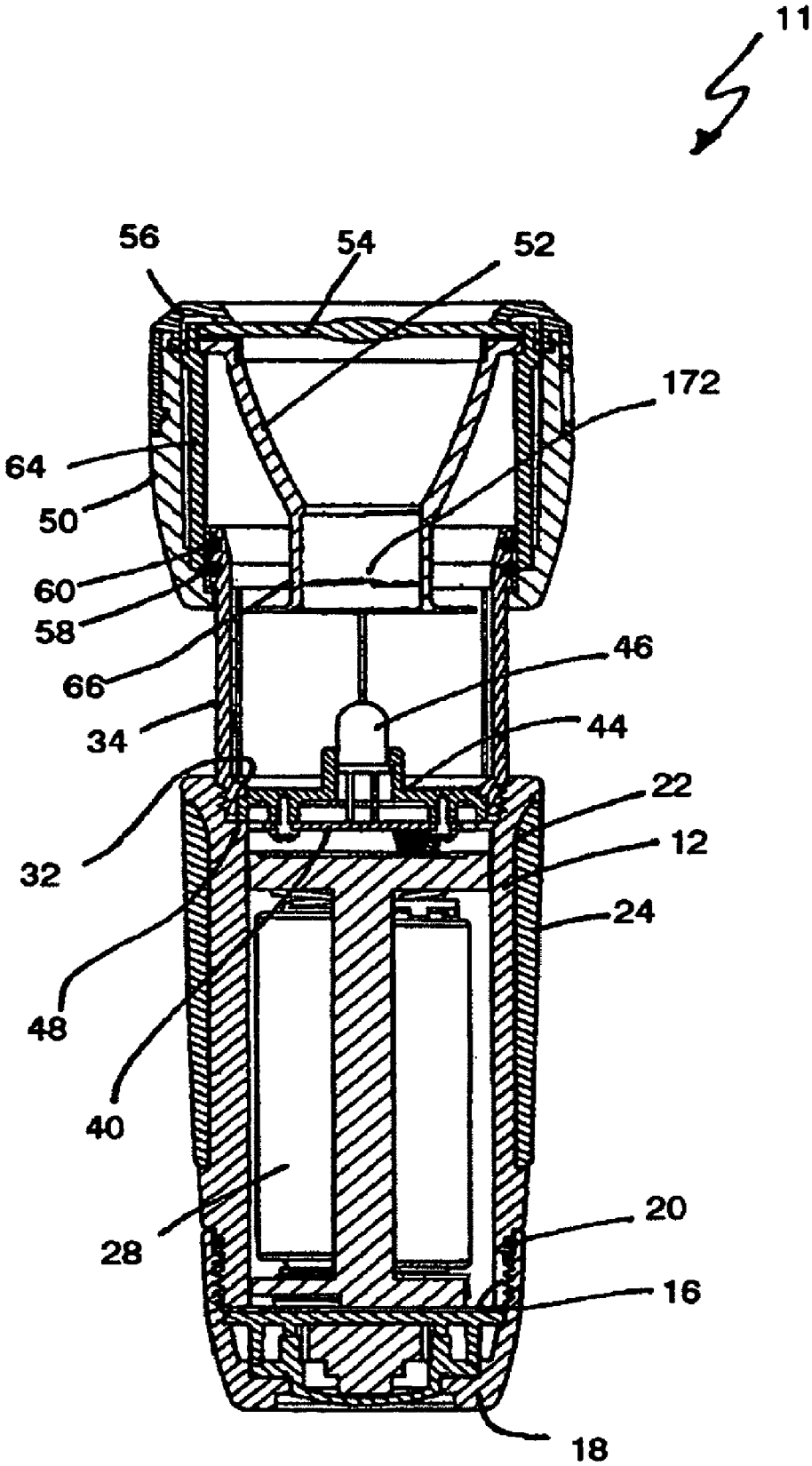
FIG. 4 illustrates the lighting device of FIG. 3 in an area light mode

Illustrated in FIG. 3 is a lighting device similar to that of FIGS. 1 and 2. Like parts have been like numbered. The difference between the lighting device 11 of FIG. 3 and the lighting device 10 of FIG. 1 is that the lighting device 11 of FIG. 3 has a shutter 170 which is made from an elastic membrane preferably of a white or light colour so that when the LED 46 protrudes through the centre of the membrane 170, any light falling on the reflector side will be reflected out through the lens 54. Further, when the member 50 is moved away from the body 12, the elastic nature of the membrane closes the aperture 172 therein leaving either a very small aperture therein or no aperture at all. In which case light hitting the underside of the shutter 170 will reflect out through the tubular lens 34.

It will be understood that the invention disclosed and defined herein extends to all alternative combinations of two or more of the individual features mentioned or evident from the text. All of these different combinations constitute various alternative aspects of the invention.

The foregoing describes embodiments of the present invention and modifications, obvious to those skilled in the art can be made thereto, without departing from the scope of the present invention.

What is claimed is:

1. A method for selectively directing light in a lighting device, comprising:

sliding a reflector, relative to a light source, to a first position to produce a beam of light, the reflector having an aperture and wherein at least a portion of the light source protrudes through the aperture; and sliding the reflector, relative to the light source, to a second position to produce an area light and preventing light from passing through the aperture.

2. The method of claim 1, further including enclosing the entirety of the light source within the reflector to produce the beam of light.

3. The method of claim 1, wherein the light source is an LED.

4. A lighting device, which is adapted to be converted between a flashlight mode and an area light mode, comprising:

a housing that receives a power supply;

a light source that receives power from the power supply;

a first lens;

a second lens;

a member movable to a first position, wherein substantially all eminating from the light source passes through the first lens and a second position wherein substantially all light emanating from the light source passes through the second lens.

5. The lighting device of claim 4, wherein the second lens is tubular and corresponds to the area light mode.

6. The lighting device of claim 5, wherein the second lens is cylindrical.

7. The lighting device of claim 6, wherein the light source is an LED.

8. A lighting device comprising:

a body;

a light source coupled to a first end of the body;

a member having a portion to receive at least a portion of the light source and the portion of the member having a shutter moveable to open and closed positions;

a tubular lens coupled to the first end of the body and the member, wherein the member is movable toward the body and away from the body;

a seal at a second end of the body; and a cap located at the second end of the body and in contact with the seal, wherein the cap includes a switch.

9. The device of claim 8, wherein the member is moved away from the body to use the lighting device in an area lighting mode.

10. The device of claim 9, wherein light emitted from the light source extends radially outward through the tubular lens.

11. The device of claim 8, wherein the member is moved toward the body to use the lighting device in a flashlight mode.

12. The device of claim 8, wherein the portion of the member is cylindrically shaped and extends rearwardly therefrom.

13. The device of claim 8, wherein the portion of the member includes an elastic membrane.

14. The device of claim 8, wherein the member includes a forward lens having a centrally thicker portion for focusing the light from the light source.

15. The device of claim 8, further comprising a mounting member at the first end of the body, the mounting member having a sub assembly comprising a printed circuit board.

16. The device of claim 8, wherein the tubular lens is translucent.

17. The device of claim 16, wherein the seal is an O ring.

18. The device of claim 8, wherein the tubular lens is transparent.

* * * * *